US007019234B1

(12) United States Patent
Mezhinsky et al.

(10) Patent No.: US 7,019,234 B1
(45) Date of Patent: Mar. 28, 2006

(54) FOOTSWITCH

(75) Inventors: Victor B. Mezhinsky, Brea, CA (US); Mark A. Hopkins, Mission Viejo, CA (US)

(73) Assignee: Alcon, Inc., Hunenberg (CH)

( * ) Notice: Subject to any disclaimer, the term of this patent is extended or adjusted under 35 U.S.C. 154(b) by 0 days.

(21) Appl. No.: 10/935,386

(22) Filed: Sep. 7, 2004

Related U.S. Application Data

(60) Provisional application No. 60/520,381, filed on Nov. 13, 2003.

(51) Int. Cl.
*H01H 3/14* (2006.01)

(52) U.S. Cl. ..... 200/86.5

(58) Field of Classification Search ..... 200/86.5; 74/512, 560
See application file for complete search history.

(56) References Cited

U.S. PATENT DOCUMENTS

| | | | | |
|---|---|---|---|---|
| 3,930,431 | A * | 1/1976 | Magadini | 84/422.1 |
| 4,267,414 | A | 5/1981 | Brueggeman | |
| 4,383,167 | A | 5/1983 | Gmeinder et al. | |
| 4,652,215 | A | 3/1987 | Kuroyanagi et al. | |
| 4,837,857 | A | 6/1989 | Scheller et al. | |
| 4,901,454 | A | 2/1990 | Walkhoff | |
| 4,965,417 | A | 10/1990 | Massie | |
| 4,983,901 | A | 1/1991 | Lehmer | |
| 5,091,656 | A | 2/1992 | Gahn | |
| 5,268,624 | A | 12/1993 | Zanger | |
| 5,554,894 | A | 9/1996 | Sepielli | |
| 5,580,347 | A | 12/1996 | Reimels | |
| 5,635,777 | A | 6/1997 | Telymonde et al. | |
| 5,787,760 | A | 8/1998 | Thorlakson | |
| 5,983,749 | A | 11/1999 | Holtorf | |
| 5,990,400 | A | 11/1999 | Hoshino | |
| 6,010,496 | A | 1/2000 | Appelbaum et al. | |
| 6,150,623 | A | 11/2000 | Chen | |
| 6,179,829 | B1 | 1/2001 | Bisch et al. | |
| 6,360,630 | B1 | 3/2002 | Holtorf | |
| 6,452,120 | B1 | 9/2002 | Chen | |
| 6,514,268 | B1 | 2/2003 | Finlay et al. | |
| D478,323 | S | 8/2003 | Peterson et al. | |
| 6,639,332 | B1 | 10/2003 | Metzler et al. | |
| 6,659,998 | B1 | 12/2003 | DeHoogh et al. | |
| 6,674,030 | B1 | 1/2004 | Chen et al. | |
| 6,743,245 | B1 | 6/2004 | Lobdell | |
| 6,862,951 | B1 * | 3/2005 | Peterson et al. | 74/512 |
| 2003/0047434 | A1 | 3/2003 | Hanson et al. | |
| 2003/0073980 | A1 | 4/2003 | Finlay et al. | |
| 2003/0213333 | A1 | 11/2003 | McVicar | |
| 2004/0106915 | A1 | 6/2004 | Thoe | |

FOREIGN PATENT DOCUMENTS

| | | | |
|---|---|---|---|
| EP | 1394828 | A1 * | 3/2004 |
| GB | 1 063 067 | A | 3/1967 |
| WO | WO 96/13845 | | 5/1996 |
| WO | WO 98/08442 | | 3/1998 |
| WO | WO 99/14648 | | 3/1999 |
| WO | WO 00/12037 | | 3/2000 |
| WO | WO 02/01310 | | 1/2002 |
| WO | WO 03/053293 | | 7/2003 |
| WO | WO 03/053294 | | 7/2003 |

* cited by examiner

*Primary Examiner*—Michael A. Friedhofer
(74) *Attorney, Agent, or Firm*—W. David Lee

(57) ABSTRACT

An improved footswitch is disclosed. The footswitch may have an adjustable length treadle to accommodate different size feet. The footswitch may also have a treadle having a slidable plate that facilitates the actuation of a side switch.

5 Claims, 3 Drawing Sheets

FOOTSWITCH

This application claims the priority of U.S. Provisional Application No. 60/520,381 filed Nov. 13, 2003.

FIELD OF THE INVENTION

This invention relates to the field of footswitches; more particularly to footswitches used to control patient treatment apparatus used by physicians, surgeons, dentists, veterinarians, etc.

DESCRIPTION OF THE RELATED ART

During the use of a complex patient treatment apparatus; for example, the handpiece used when performing ophthalmic surgery, the control of a variety of different subsystems such as pneumatic and electronically driven subsystems is required. Typically, the operation of the subsystems included in a complex patient treatment apparatus is controlled by a microprocessor-driven console that receives mechanical inputs from either the user of the device or from an assistant. A control device, generically known as a footswitch, is often used for receiving the mechanical inputs which originate from the movement of the foot of a user to govern the operation of a sub-system. The mechanical inputs from the movement of the foot of the user become electrical signals which are used to control the operational characteristics of a subsystem in a complex patient treatment apparatus.

Examples of footswitches that are designed for receiving mechanical inputs from the movement of the foot of a user operating a complex patient treatment apparatus may be found in U.S. patents, including U.S. Pat. No. 4,837,857 (Scheller, et al.); U.S. Pat. No. 4,965,417 (Massie); U.S. Pat. No. 4,983,901 (Lehmer); U.S. Pat. No. 5,091,656 (Gahn); U.S. Pat. No. 5,268,624 (Zanger); U.S. Pat. No. 5,554,894 (Sepielli); U.S. Pat. No. 5,580,347 (Reimels); U.S. Pat. No. 5,635,777 (Telymonde, et al.); U.S. Pat. No. 5,787,760 (Thorlakson); U.S. Pat. No. 5,983,749 (Holtorf); and U.S. Pat. No. 6,179,829 B1 (Bisch, et al.); and in International Patent Application Publication Nos. WO 98/08442 (Bisch, et al.); WO 00/12037 (Chen); and WO 02/01310 (Chen). These aforementioned patents and patent applications focus primarily on footswitches which include a foot pedal or tiltable treadle. The movement of the foot pedal or tiltable treadle typically provides a linear control input such as may be used, for example, for regulating rotational speed, power, or reciprocal motion.

In more complex footswitch assemblies, side or wing switches are typically located on either side of the foot pedal or tiltable treadle. The condition of these side or wing switches is changed by the application of pressure from the front portion of the user's foot or from the rear portion of the user's foot. However, given the ever-increasing complexity of patient treatment apparatus, there remains a need in the art to provide additional control features on a footswitch; while, at the same time, not making the footswitch overly complex. It has been found that one of the most usable additional control features would be a second separate proportional control input beyond the linear control input provided by a single foot pedal or tiltable treadle. In addition, there is a need to assure that the footswitch is ergonomically sound to minimize fatigue of the user's foot or leg, as such fatigue may cause improper control inputs. Such improper control inputs have the potential of injuring a patient.

SUMMARY OF THE INVENTION

In one aspect, the present invention is a footswitch including a base assembly and a pivotable treadle mounted on the base assembly for providing a control output. The treadle has an adjustable length to accommodate different size feet.

In another aspect, the present invention is a footswitch including a base assembly, a side switch mounted on the base assembly for providing a first control output; and a pivotable treadle mounted on the base assembly for providing a second control output. The treadle has a top surface and a plate on the top surface. The plate is slidably disposed along a linear path relative to the top surface so as to facilitate actuation of the side switch by the user's foot.

The present invention minimizes fatigue of the user's foot or leg and helps to insure proper use of the footswitch.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE PREFERRED EMBODIMENTS

Figure 1:
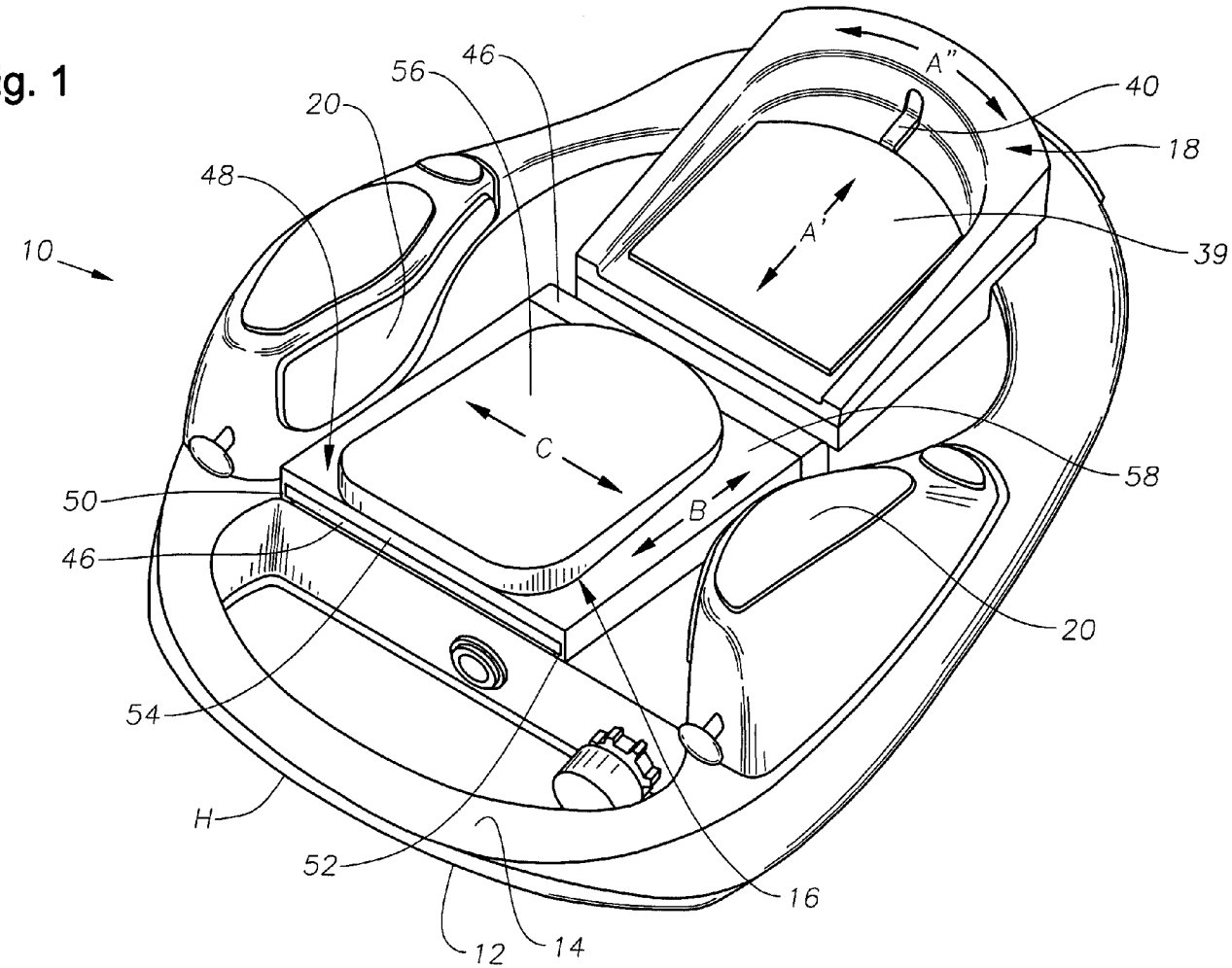
FIG. 1 is a perspective view of the dual control footswitch assembly of the present invention.
Figure 2:
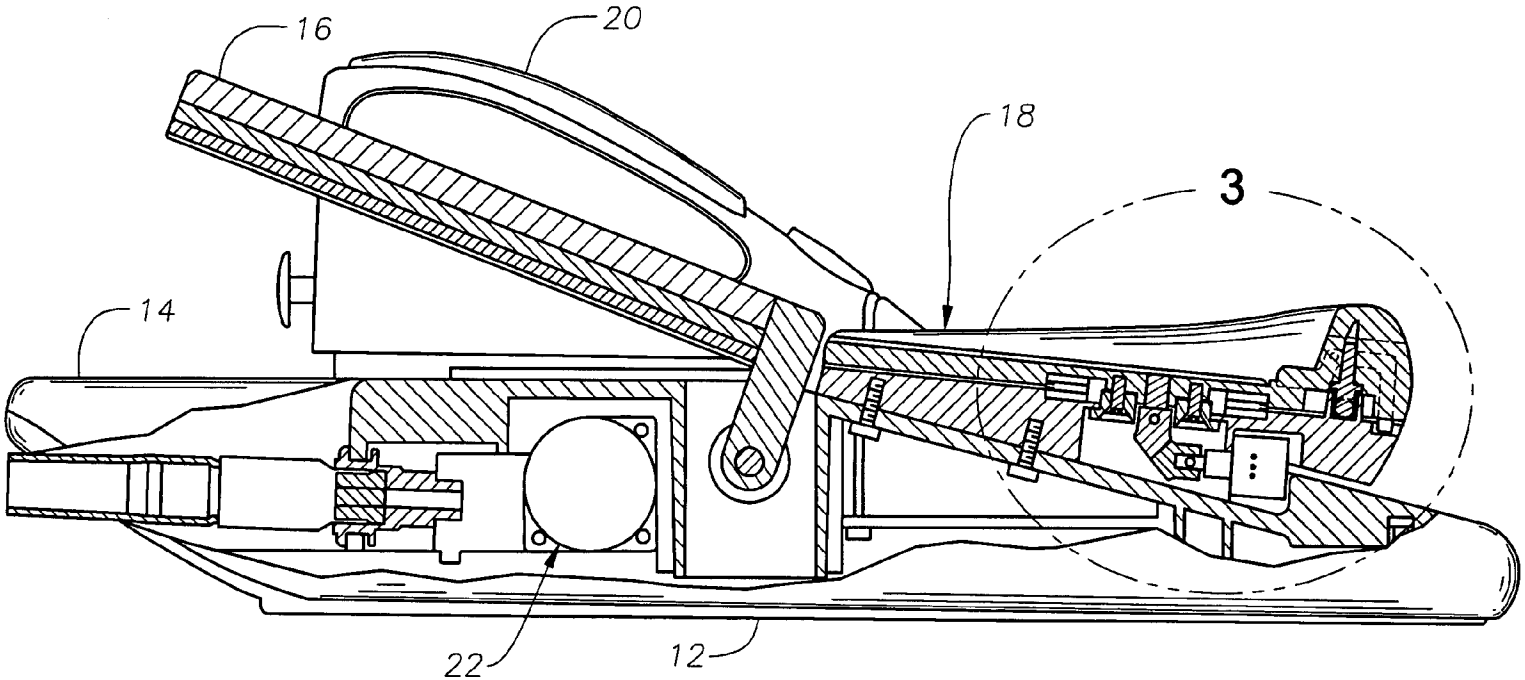
FIG. 2 is an elevational view in partial section of the disclosed footswitch assembly.
Figure 3:
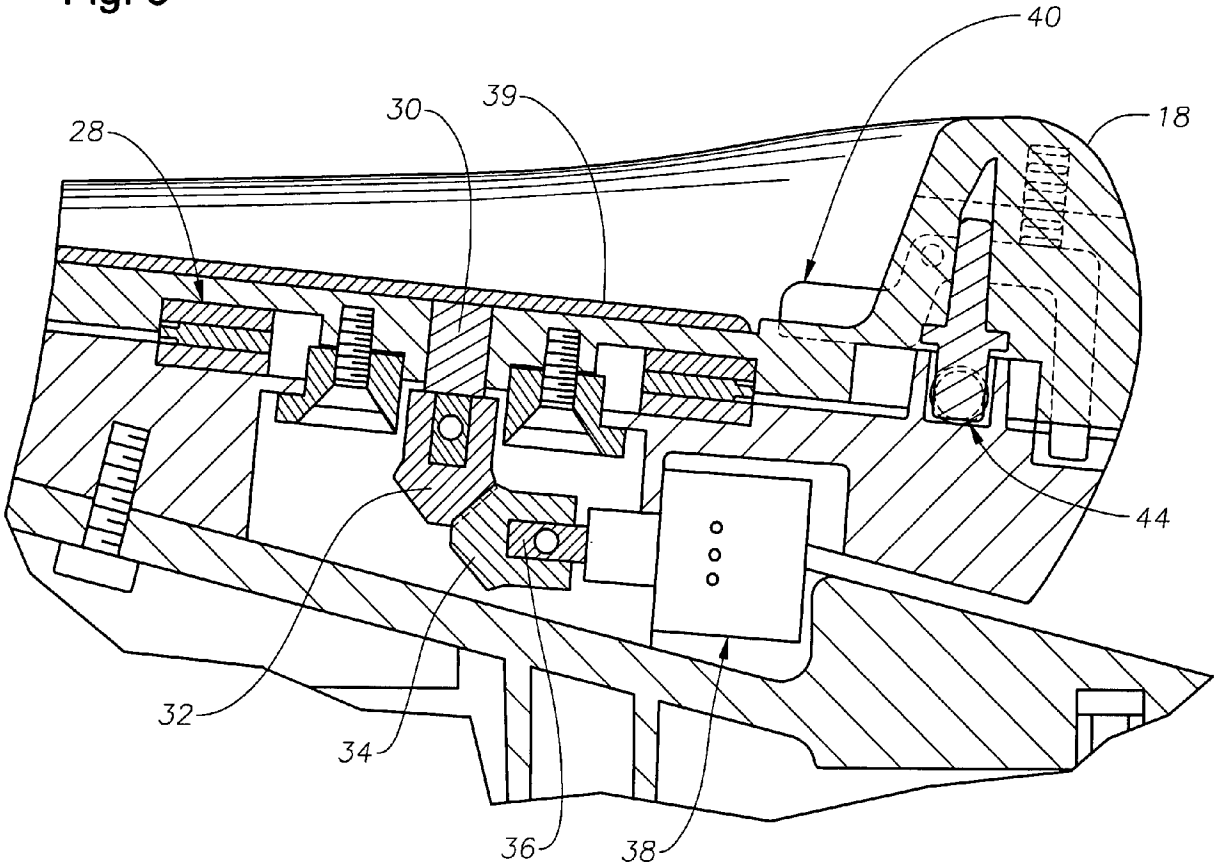
FIG. 3 is an enlarged elevational view in partial section of the encircled portion of the heel support assembly shown in FIG. 2.

The preferred embodiments of the present invention and their advantages are best understood by referring to FIGS. 1 through 3 of the drawings, like numerals being used for like and corresponding parts of the various drawings.

As best seen in FIG. 1 and FIG. 2, a preferred embodiment of the footswitch assembly 10 of the present invention generally includes a bottom housing 12, a top housing 14, a foot pedal or tiltable treadle 16, a separate heel cup assembly 18, a handle position H in the front, and side or wing switches 20.

Attached to the foot pedal or tiltable treadle 16 is a DC motor/encoder 22. The angular position of the foot pedal or treadle 16, which is tiltable with respect to a horizontal plane or to a neutral or home plane, provides the first system for converting of mechanical input from movement of the user's foot into an electrical signal. Thus, the movement of the foot pedal or tiltable treadle 16 provides a proportional control input, which is preferably a linear control input.

As shown in the drawing figures, the footswitch assembly 10 of the present invention provides a second separate proportional control input using the disclosed construction of the heel cup assembly 18. The heel cup assembly 18 is positioned at the rear portion of the footswitch 10 to engage the user's heel. The heel cup assembly 18 is positioned over a thrust bearing assembly 28. Such construction allows the user to rotate the heel cup assembly 18 through an arcuate path while the user's heel effectively remains in the same spot.

In the preferred embodiment and as shown in FIG. 3, a shaft 30 is attached to the bottom of the heel cup assembly 18. The shaft 30 is connected to a first bevel gear 32. The first bevel gear 32 is positioned to be in mating engagement with a second bevel gear 34. As the heel cup assembly 18 is rotated in an arcuate motion as shown by the arrow marked A" in FIG. 1, the shaft 30 also rotates. This rotational motion causes rotation of the first bevel gear 32. The contact between the teeth on the first bevel gear 32 and the teeth on the second bevel gear 34 rotates a shaft 36 which is connected to an angular position potentiometer 38. This mechanical input into the angular position potentiometer 38 provides an electrical signal. The electrical signal from the potentiometer 38 is the second control signal. This control signal may be either linear or non-linear. In an alternate construction, the potentiometer 38 could be placed directly under the heel of the user.

To further enhance control of the second control signal, a simple on/off switch, well known to those of ordinary skill in the art, may be included in the heel cup assembly 18 to activate the signal output from the potentiometer 38. Alternatively, such on/off switches could also be used to prevent inadvertent activation of the side switches 20. Such on/off switch may be a slide switch moving along the linear path within the heel cup assembly 18 as is designated by the arrow marked A' illustrated in FIG. 1. In another embodiment, heel cup assembly 18 has a plate 39 that is slidable along the linear path marked by arrow A' under the application of a force by the user's foot. This movement of plate 39 also actuates the on/off switch. The on/off switch may be a Hall effect sensor. The user will be able to change the condition of this switch irrespective of the rotational position of the heel cup assembly 18.

Further on FIG. 1, foot pedal or treadle 16 may be composed of a base structure 46 and a plate 48. Base structure 46 is tiltable or pivotable with respect to a horizontal plane or to a neutral or home plane, as decribed above. Base structure 46 is preferably received by flanges 50 and 52 of plate 48. Plate 48 is movable with respect to base structure 46 along the linear path marked by arrow B in FIG. 1, and may preferably be adjusted to selected positions along this path. An end 54 of plate 48 may thus be adjusted closer to or farther away from heel cup assembly 18 to adjust the length of treadle 16 to accommodate different size feet.

Still further on FIG. 1, foot pedal or treadle 16 may have an anti-friction plate 56 on a top surface 58 of plate 48. Plate 56 is slidably disposed on top surface 58 along the linear path marked by arrow C in FIG. 1. Plate 56 is thus movable from side to side to facilitate a user's ability to actuate side or wing switches 20.

In yet another embodiment, a mechanical or electrical latching mechanism 40, well known to those of ordinary skill in the art, may be included to release the heel cup assembly 18, and thus allow it to rotate. In the preferred embodiment, a return spring 44 is also included to allow the entire heel cup assembly 18 to return it to a home or neutral position.

While the present system and method has been disclosed according to the preferred embodiment of the invention, those of ordinary skill in the art will understand that other embodiments have also been enabled. Such other embodiments shall fall within the scope and meaning of the appended claims.

What is claimed is:

1. A footswitch, comprising:

a base assembly;

a pivotable treadle mounted on said base assembly for providing a control output, said treadle having:

a base structure that is pivotably coupled to said base assembly, and a plate receiving said base structure and that is slidably disposed along a linear path relative to said base structure so as to change a length of said treadle; and a heel cup mounted on said base assembly separate from said treadle.

2. The footswitch of claim 1 wherein said plate is adjustable to selected positions.

3. The footswitch of claim 1 wherein said plate is slidably disposed so as to change a distance between a distal end of said plate and said heel cup.

4. A footswitch, comprising:

a base assembly;

a side switch mounted on said base assembly for providing a first control output;

a pivotable treadle mounted on said base assembly for providing a second control output, said treadle having a top surface and a plate on said top surface, said plate being slidably disposed along a linear path relative to said top surface and transverse to a longitudinal axis of said footswitch so as to facilitate actuation of said side switch by a user's foot.

5. The footswitch of claim 4 wherein said plate is an anti-friction plate.

* * * * *